United States Patent [19]

Bachman

[11] Patent Number: 4,913,341

[45] Date of Patent: Apr. 3, 1990

[54] CURRENCY STORAGE DEVICE

[76] Inventor: Theodore L. Bachman, 18418 Sterling Silver Cir., Lutz, Fla. 33549

[21] Appl. No.: 292,812

[22] Filed: Jan. 3, 1989

[51] Int. Cl.[4] ..... G07B 15/00

[52] U.S. Cl. ..... 232/1 D; 232/15

[58] Field of Search ..... 232/1 D, 15, 16, 31

[56] References Cited

U.S. PATENT DOCUMENTS

| | | | |
|---|---|---|---|
| 4,313,601 | 2/1982 | Graef et al. | 232/1 D X |
| 4,423,826 | 1/1984 | Hirata et al. | 232/15 X |
| 4,434,931 | 3/1984 | Hunt et al. | 232/15 |
| 4,790,476 | 12/1988 | Tanaka et al. | 232/1 D |
| 4,798,316 | 1/1989 | Martin et al. | 232/1 D X |

*Primary Examiner*—Robert W. Gibson, Jr.
*Attorney, Agent, or Firm*—A. W. Fisher, III

[57] ABSTRACT

A currency storage device for stacking and storing paper currency and the like comprising a currency storage stand or pedestal having a currency drawer recess formed therein to selectively receive a currency drawer therein and a currency slot formed thereon to feed paper currency to the currency drawer, the currency drawer comprising an outer currency drawer housing having an inner currency storage tray removably disposed therein and a currency positioning device movable between a first and second position mounted thereon, the outer currency drawer housing including a currency receiving aperture and currency receiving zone to receive paper currency through the currency slot and the inner currency storage tray including a currency storage tray aperture disposed to selectively receive currency from the currency receiving zone when the currency positioning device is moved from the first to second position and a currency alignment structure to align currency in the currency receiving zone relative to the currency positioning device and currency storage tray aperture.

23 Claims, 4 Drawing Sheets

CURRENCY STORAGE DEVICE

BACKGROUND OF THE INVENTION

1. Field of the Invention

A currency storage device for stacking and storing paper currency and the like.

2. Description of the Prior Art

Various containers have been designed for storing paper or relatively resilient cards or notes such as banknotes, postal orders, credit cards, security tags, tickets, vouchers, invoices and the like. Such devices are used to temporarily store paper notes usually held in a horizontal or vertical stack by means of a spring loaded clamp as in a cash register or adjacent lockable drawer. In either case, when additional notes are to be stored, the existing stack of notes is temporarily exposed with the risk of theft. Thus, security boxes commonly referred to as "drop boxes" are employed. Periodically, personnel remove the "drop box" from the secured position to a secure area for accounting.

U.S. Pat. No. 3,854,655 relates to a container for storing banknotes or the like comprising a reception chamber for receiving notes, a storage chamber for storing such notes, means forming a constriction between the reception and storage chambers of width less than that of the smallest note to be handled and a plunger for forcing the notes from the reception chamber through the constriction to the storage chamber. Two separate keys are necessary to remove and gain access to the container.

U.S. Pat. No. 4,452,390 teaches a portable safe locked within a housing located at a work station for receiving currency deposited directly into the safe without exposing the contents of the safe. The safe includes a currency transfer tray movable into and out of the container and a pivoting wiper element for sweeping the transfer tray to discharge currency from the currency transfer tray into the safe.

U.S. 3,101,892 discloses a bill-receiving cash box to guide bills into a small area without jamming.

U.S. Pat. No. 4,434,931 shows a cash box for currency having an opening through which bills are introduced into the cash box to form a stack of currency within the cash box. A closure is movable to an open position to permit bills to be introduced therethrough. The closure is movable to a closed position adjacent the opening to prevent the removal of paper currency from the stack of currency. A latch for the closure permits the closure to be moved between the open and closed positions.

U.S. Pat. No. 4,278,033 discloses a tamper resistant safe including an enclosure body formed to define a top opening. The top opening is enlarged and includes part of one side and part of the top to provide easy access to the safe interior. The enclosure top and side portions immediately adjacent to the opening include reinforcing constructions which cooperate with a sliding cover in a manner to reinforce and protect all junctions to discourage unauthorized entry therethrough.

Additional examples of the prior art are found in U.S. Pat. Nos. 1,624,772; 1,917,517; 2,429,494; 2,465,431; 3,026,023; 3,052,468; 3,087,724; 3,120,384; 3,741,132; 3,799,539; 3,854,613; 3,917,260; 4,000,892; 4,019,730; 4,045,017; 4,051,790; 4,418,824; 4,451,030 and U.S. Pat. No. 4,529,118.

SUMMARY OF THE INVENTION

The present invention relates to a currency storage device comprising a currency storage stand or pedestal having a currency drawer including an outer currency drawer housing and inner currency storage tray removably disposed therein.

The currency storage stand or pedestal comprises a currency storage housing including a currency drawer recess to house the currency drawer and a currency slot to feed to the currency drawer. A currency drawer securing means selectively secures the currency drawer within the currency drawer recess.

The outer currency drawer housing comprises a currency drawer enclosure having a currency positioning means and a currency access door disposed at opposite ends thereof and a currency receiving aperture formed on the top wall thereof. A currency receiving zone is formed in the forward portion of the currency drawer enclosure disposed in operative relationship relative to the currency positioning means and currency receiving aperture. The outer currency drawer housing further includes a currency drawer lock means to selectively lock the inner currency storage tray therein.

The outer currency drawer housing also includes a currency alignment means comprising an upper and lower currency alignment structure to align paper currency in the currency receiving zone relative to the currency positioning means and the inner currency storage tray.

The inner currency storage tray comprises a currency tray including a currency storage tray aperture aligned in registry relative to the currency receiving zone to receive currency therefrom when the currency positioning means is moving from a first to second position. A resilient bias currency storage retainer is disposed between the storage tray flanges and the rear wall of the inner currency storage tray to retain the currency A therein. A resilient bias currency storage retainer is disposed within the inner currency storage tray to retain the currency therein.

In operation, the inner currency storage tray in inserted into the outer currency drawer housing. The currency access door is then closed and locked. The currency drawer is then inserted into the currency drawer recess and secured therein by the currency drawer securing means.

So configured, the currency slot is aligned with the currency receiving zone. The upper currency alignment structure aligns the currency relative to the currency positioning means; while, the lower currency alignment structure aligns the currency relative to the inner currency storage tray. The currency is then moved from the currency receiving zone to the inner currency storage tray by moving the positioning means from the first to second position.

The currency drawer may be removed from the currency storage stand or pedestal by operating the currency drawer securing means. The inner currency storage tray may then be removed from the outer currency drawer housing by operating the currency drawer lock means to permit access to the currency.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
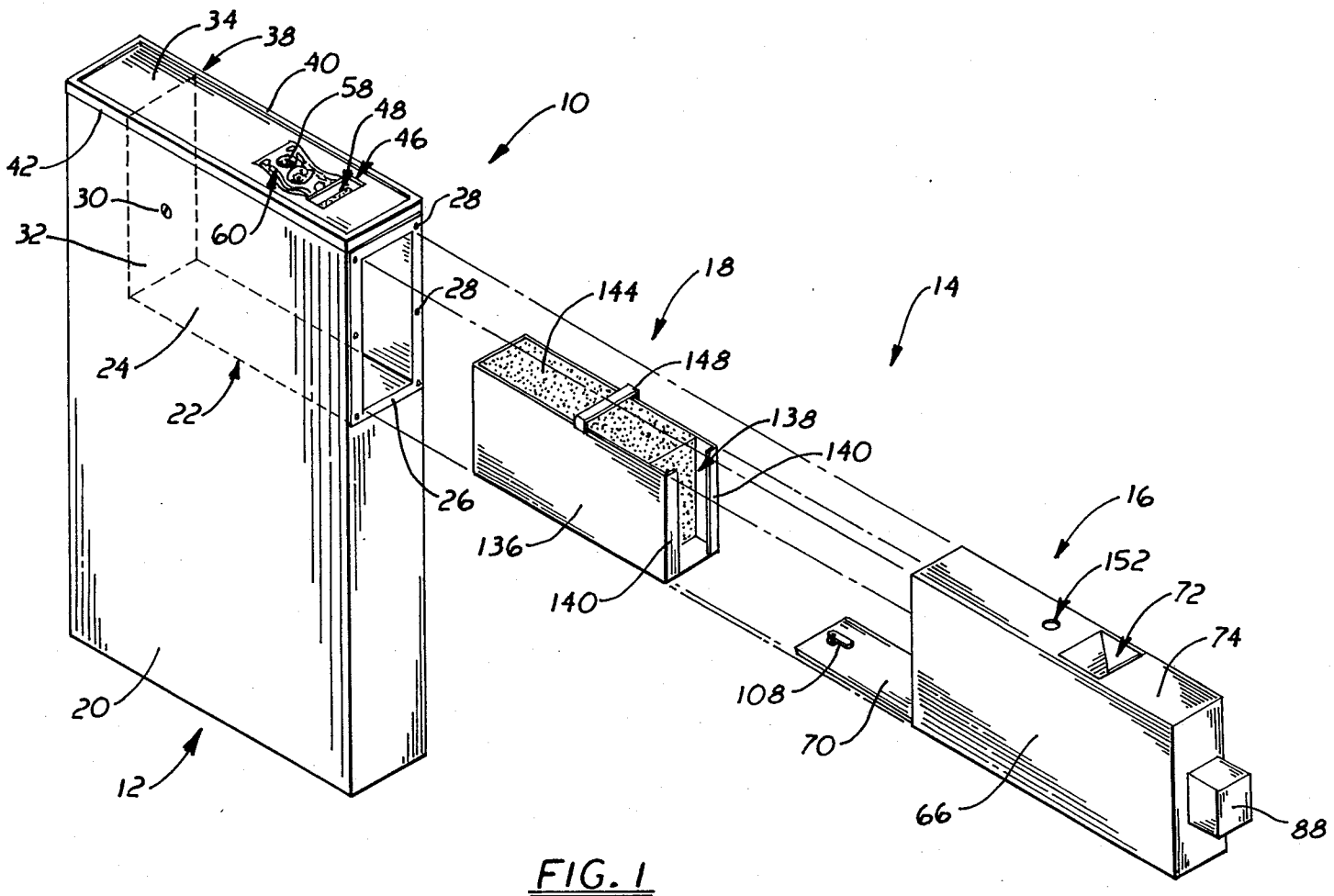
FIG 1 is an exploded perspective view of the currency storage device.

As shown in FIG. 1, the present invention relates to a currency storage device generally indicated as 10 comprising a currency storage stand or pedestal generally indicated as 12 having a currency drawer generally indicated as 14 including an outer currency drawer housing and inner currency storage tray generally indicated as 16 and 18 respectfully removably disposed therein.

Figure 2:
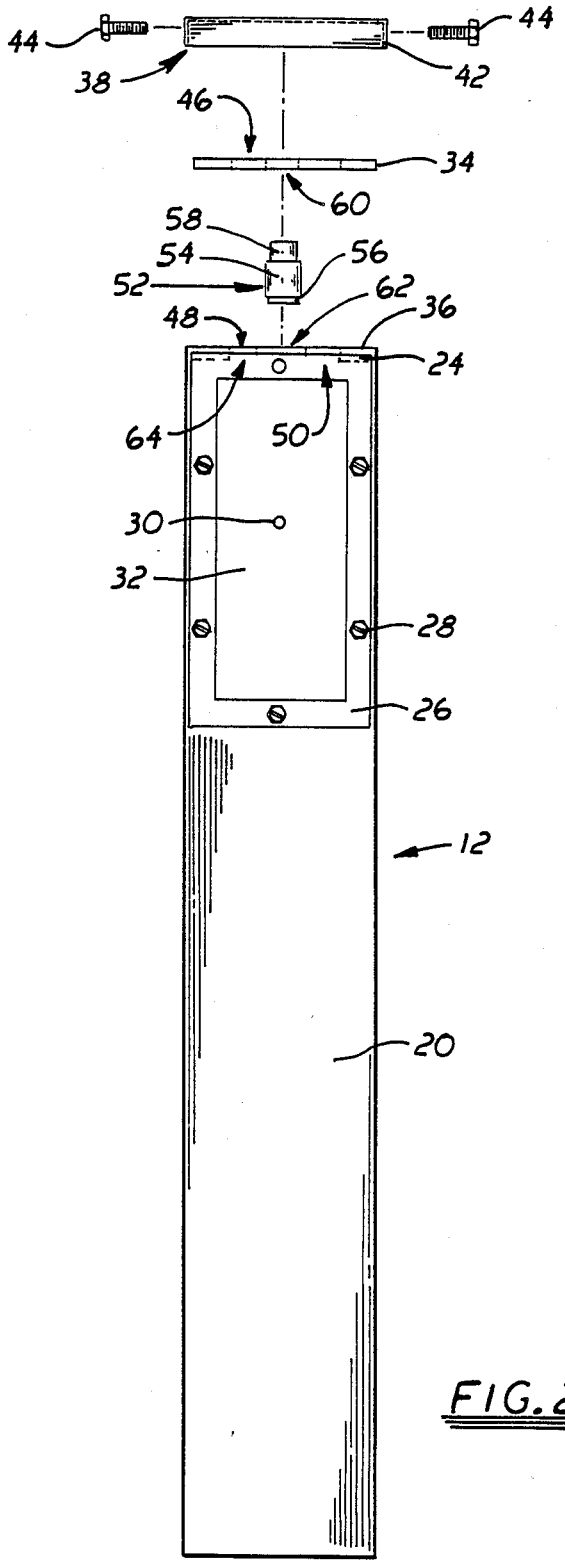
FIG. 2 is a exploded front view of the currency device.
Figure 3:
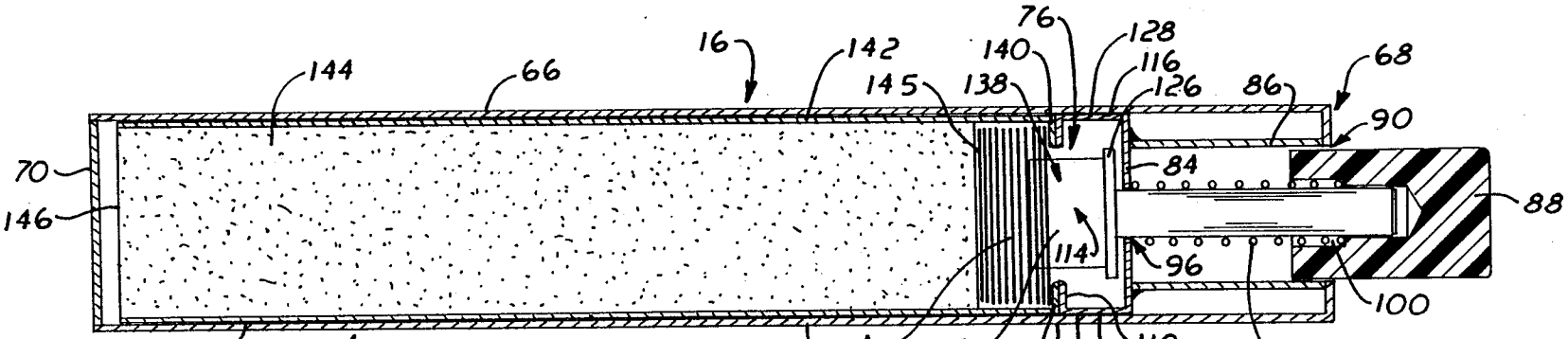
FIG. 3 is a cross-sectional top view of the currency drawer with the currency positioning means in the first position.
Figure 4:
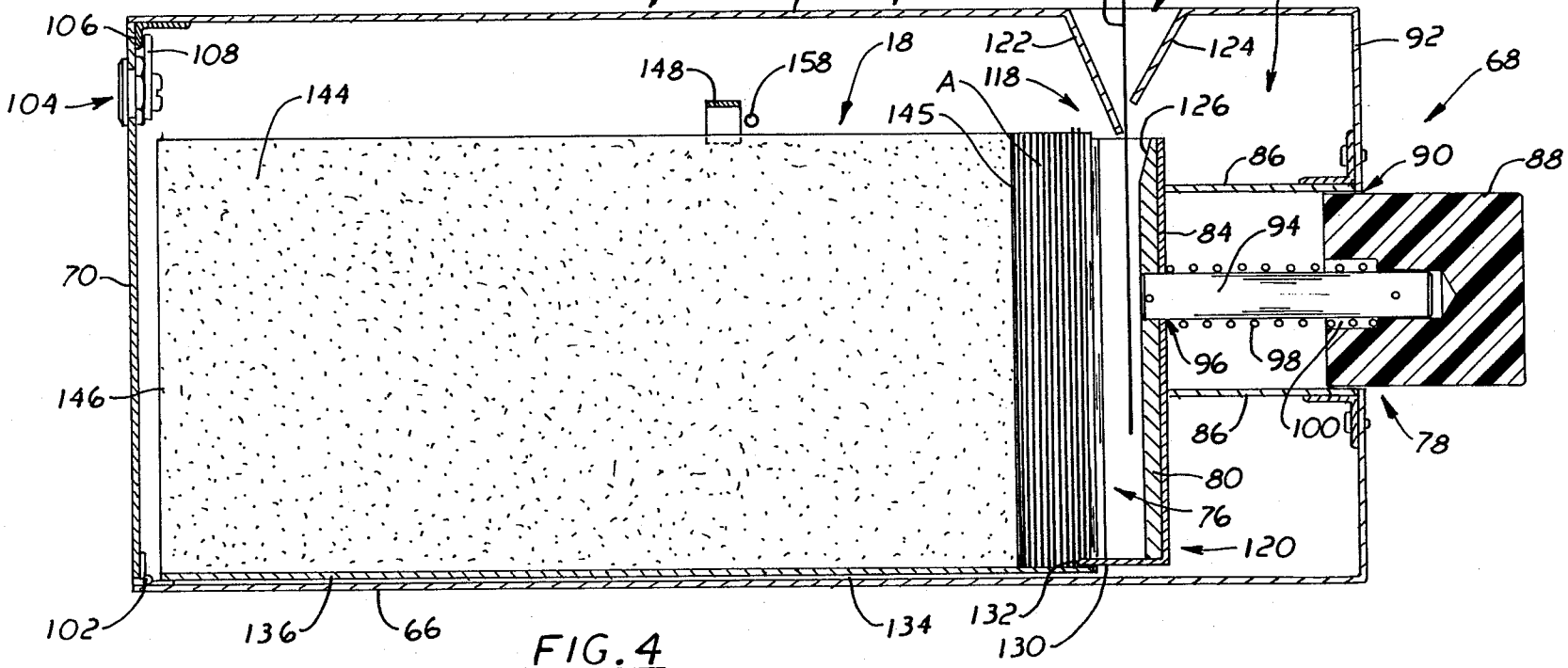
FIG. 4 is cross-sectional side view of the currency drawer with the currency positioning means in the first position.

As shown in FIGS. 1 and 2, the currency storage stand or pedestal 10 comprises a currency storage housing 20 having a currency drawer recess 22 formed therein and a metal sleeve 24 having a mounting flange 26 formed about the outer periphery thereof within secured within the currency drawer recess 20. The metal sleeve 24 is affixed to the currency storage housing 20 by a plurality of outer fastening means each indicated as 28 attached to the mounting flange 26 and an inner fastening means 30 attached to the inner end 32 of the metal sleeve 24.

As shown in FIGS. 1 and 2, a top plate 34 may be mounted to the upper surface or top wall 36 of the currency storage housing 20 by a retainer frame generally indicated as 38 including a substantially horizontal retainer lip 40 overlapping the periphery of the top plate 34 and a substantially vertical retainer flange 42 affixed to the upper portion of the currency storage housing 20 by a plurality of retainer fastening means each indicated as 44. It should be noted that the substantially vertical retainer flange 42 also overlaps the upper portion of the mounting flange 26.

As shown in FIGS. 1 and 2, currency slots 46, 48 and 50 are formed in the top plate 34, upper surface or top wall 36 and metal sleeve 24 respectively. The currency slots 46, 48 and 50 are aligned to feed currency A to the currency drawer 14 as described more fully hereinafter.

As shown in FIGS. 1 and 2, a currency drawer securing means generally indicated as 52 is affixed to the top wall 36 of the currency storage housing 20. The currency drawer securing means 52 comprises a securing housing 54 affixed to the inside of the currency storage housing 20 by a mounting member 56 and a key actuated securing pin or member 58 movable between a first and second position by a first key (not shown) operably disposed within the securing housing 54 to selectively secure the currency drawer 14 within the currency drawer recess 22 when in the second position as described more fully hereinafter. The top plate 34, upper surface or top 36 and metal sleeve 24 include securing means apertures 60, 62 and 64 respectively to receive the currency drawer securing means 52.

As best shown in FIGS. 3 through 6, the outer currency drawer housing 16 comprises a currency drawer enclosure 66 having a currency positioning means generally indicated as 68 and a currency access door 70 disposed at opposite ends thereof and a currency receiving aperture 72 formed on the top wall 74 thereof. A currency receiving zone 76 is formed in the forward portion of the currency drawer enclosure 66 disposed in operative relationship relative to the currency positioning means 68 and currency receiving aperture 72.

The currency positioning means 68 comprises plunger generally indicated as 78 and a currency positioning member 80 mounted to the forward portion of the currency drawer enclosure 66 by a currency frame generally indicated as 82.

The currency position frame 82 comprises an inner frame member 84 affixed to the currency drawer enclosure 66 by a pair of frame interconnecting members each indicated as 86.

The plunger 78 comprises an actuator member 88 disposed within an actuator aperture 90 formed in the front wall 92 of the currency drawer enclosure 66 operatively interconnected to the currency positioning member 80 by a shaft 94 disposed within a shaft aperture 96 formed in the inner frame member 84. The currency positioning means 68, movable between a first and second position, is normally biased in the first position by a bias means or spring 98 extending between the inner frame member 84 and a bias recess 100 formed in the actuator member 88.

The currency access door 70 is hingedly coupled to the currency drawer enclosure 66 by a hinge 102.

The outer currency drawer housing 16 further includes a currency drawer lock means generally indicated as 104 to selectively lock the inner currency storage tray 18 therein. Specifically, the currency drawer lock means 104 comprises a key actuated lock including a stationary latch member 106 affixed to the interior of the currency drawer enclosure 66 and a lock member 108 mounted on the currency access door 70 movable between a first and second position by a second key (not shown) to lock the currency assess door 70 to the currency drawer enclosure 66 by engagement between the stationary latch member 106 and lock member 108 when in the second position.

The currency receiving zone 76 is cooperatively formed by the currency positioning member 80 and a pair of lateral receiving zone flanges each indicated as 110 extending inwardly from opposite side walls 112 of the currency drawer enclosure 66. The pair of lateral receiving flanges 110 cooperatively form a currency drawer aperture 114 having a width slightly less than the width of the currency A. Alternately, the pair of lateral receiving flange 110 may be formed on extension legs 116 extended from opposite sides of the inner frame member 54.

The outer currency drawer housing 14 also includes a currency alignment means comprising an upper and lower currency alignment structure generally indicated as 118 and 120 respectively to align currency in the currency receiving zone 76 relative to the currency positioning means 68 and inner currency storage tray 18 respectively.

The upper currency alignment structure 118 comprises a first and second upper inclined currency alignment plate indicated as 122 and 124 respectively extending inwardly from the top wall 74 of the currency drawer enclosure 66 on opposite sides of the currency receiving aperture 72, inclined currency camming surface 126 formed on the upper portion of the currency positioning member 80 and a pair of upper lateral inclined currency alignment camming surfaces each indicated as 128 formed on the extension legs 116 or the side walls of the currency drawer enclosure 66 adjacent the currency receiving aperture 72. The first and second upper inclined currency alignment plates 122 and 124 extend toward each other to cooperatively form a funnel therebetween. The first upper inclined currency alignment plate 122 extends below the second upper inclined currency alignment plate 124 toward the inclined camming surface 126 to direct the currency A into the currency receiving zone 76.

The lower currency alignment structure 120 comprises a lower currency alignment plate 130 including an inclined camming surface 132 formed on the lower portion of the currency positioning member 80 disposed above the bottom 134 of the inner currency storage tray 18 when disposed within the outer currency drawer housing 16.

Figure 5:
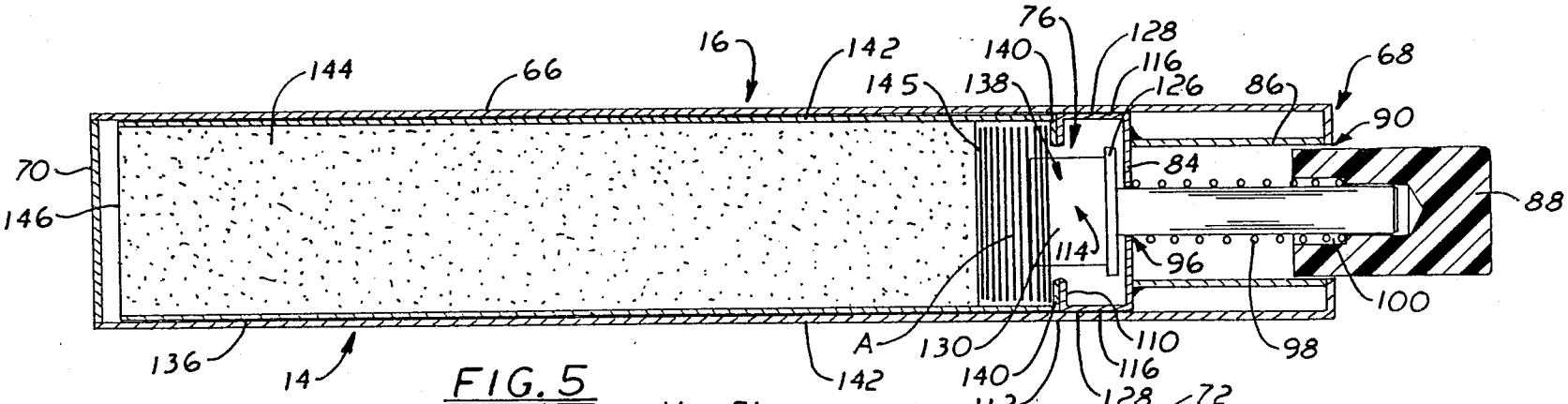
FIG. 5 is a cross-sectional top view of the currency drawer with the currency positioning means in the second position.
Figure 6:
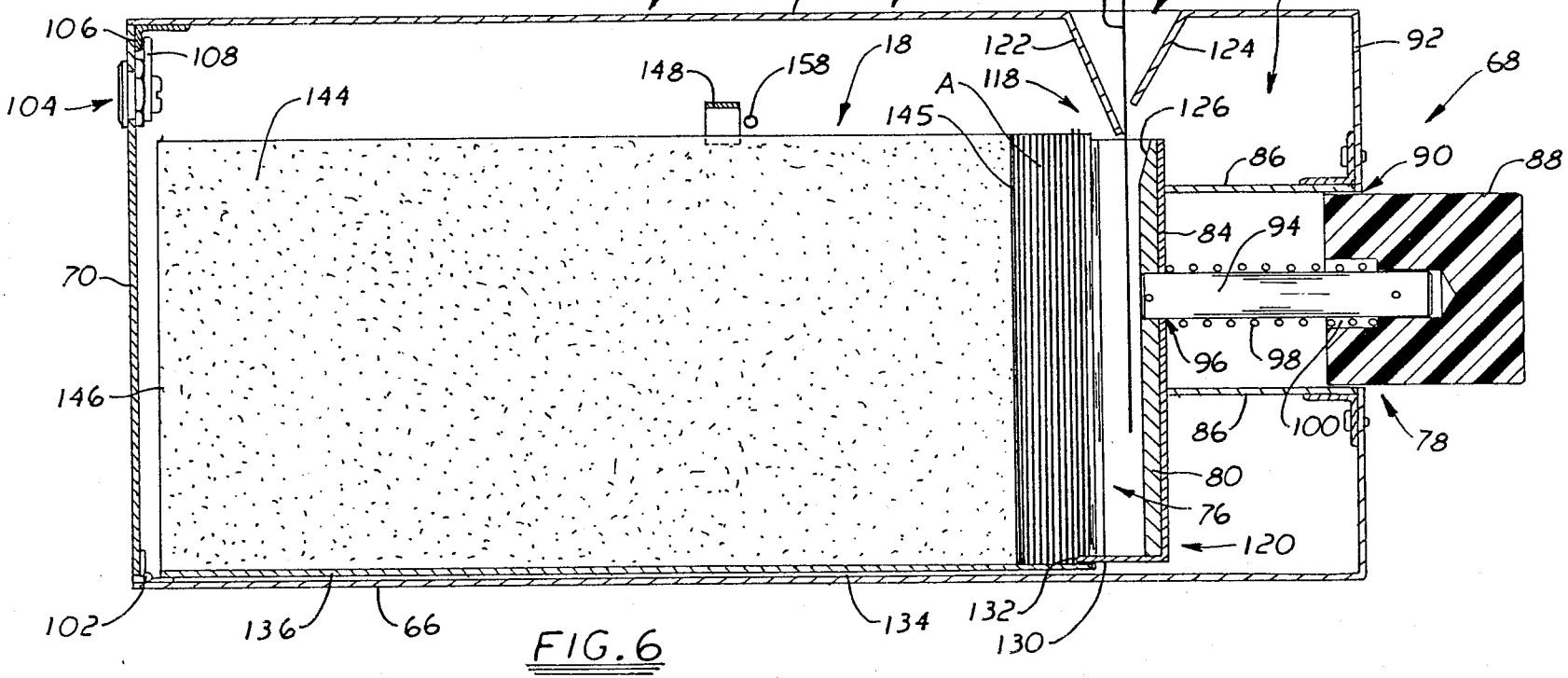
FIG. 6 is a cross-sectional side view of the currency drawer with the currency positioning means in the second position.

As best shown in FIGS. 3 through 6, the inner currency storage tray 18 comprises a currency tray 136 including a currency storage tray aperture 138 having a width slightly less than the width of currency A cooperatively formed by a pair of storage tray flanges 140 extending inwardly from opposite side walls 142 of the currency tray 136. The currency storage tray aperture 138 is aligned in registry relative to the currency drawer aperture 114 to receive currency A from the currency receiving zone 76 when the currency positioning means 68 is moving from the first to second position as shown in FIGS. 5 and 6.

A resilient bias currency storage retainer 144 and rigid retainer plate 145 is disposed between the storage tray flanges 140 and the rear wall 146 of the inner currency storage tray 18 to retain the currency A therein.

The currency drawer 14 further includes a longitudinal currency storage tray alignment means to align the inner currency storage tray 18 longitudinally relative to the currency receiving zone 76. The longitudinal storage tray alignment means comprises a first currency storage tray alignment member 148 formed on the inner currency storage tray 18 and a second currency storage tray alignment member 150 formed on the outer currency drawer housing 16 such that the currency storage tray aperture 138 is operatively disposed adjacent the currency receiving zone 76 when the first currency storage tray alignment member 148 engages the second currency storage tray alignment member 150 whereby currency A is fed from the currency receiving zone 76 to the inner currency storage tray 18 when the plunger 78 is moved from the first to second position.

In operation, an inner currency storage tray 18 is inserted into the outer currency drawer housing 16 until the first and second currency storage tray alignment members 148 and 150 engage. The currency access door 70 is then closed and locked by moving the lock member 108 from the first to second position The currency drawer 14 is then inserted into the metal sleeve 24 affixed within the currency drawer recess 20. The key actuated securing pin or member 58 is then moved to the second position such that the lower portion thereof extends through the securing aperture 152 formed in the top wall of the currency drawer enclosure 66 to secure the currency drawer 14 within the currency storage stand or pedestal 12.

So configured, the currency slots 46, 48 and 50 are aligned with the currency receiving aperture 72 whereby currency A is fed therethrough to the currency receiving zone 76. The upper currency alignment structure 118 aligns the currency relative to the currency positioning means 68 while the lower currency alignment structure 120 aligns currency A relative to the inner currency storage tray 18. The currency A is then moved from the currency receiving zone 76 to the inner currency storage tray 18 by moving plunger 78 from the first to second position.

The currency drawer 14 may be removed from the currency storage stand or pedestal 12 by operating the key actuator pin or member 58 from the second to first position. Access to the inner currency storage tray 18 is achieved by moving the lock member 108 from the second to first position disengaging the stationary latch member 106.

The currency A may then be removed from the inner currency storage tray 18.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A currency storage device for stacking and storing paper currency and the like comprising a currency storage stand or pedestal having a currency drawer recess formed therein to selectively receive a currency drawer therein and a currency slot formed thereon to feed currency to said currency drawer, said currency drawer comprising an outer currency drawer housing having an inner currency storage tray removably disposed therein and a currency positioning means movable between a first and second position mounted thereto, said outer currency drawer housing including a currency receiving aperture and currency receiving zone to receive currency through said currency slot and said inner currency storage tray including a currency storage tray aperture disposed to selectively receive currency from said currency receiving zone when said currency positioning device is moved from said first position to second position and a currency alignment means to align currency in said currency receiving zone relative to said currency positioning means and said currency storage tray aperture.

2. The currency storage device of claim 1 wherein said outer currency drawer housing comprises a currency drawer enclosure having said currency positioning means and a currency access door disposed at opposite ends thereof.

3. The currency storage device of claim 2 wherein said currency access door is hingedly coupled to said currency drawer enclosure.

4. The currency storage device of claim 3 wherein said outer currency drawer housing further includes a currency drawer lock means to selectively lock the inner currency storage tray therein.

5. The currency storage device of claim 4 wherein said currency drawer lock means comprises a key actuated lock including a stationary latch member affixed to the interior of said currency drawer enclosure and a lock member mounted on said currency access door movable between a first and second position to lock said currency assess door to said currency drawer enclosure when in the said second position.

6. The currency storage device of claim 2 wherein said currency positioning means comprises plunger and a currency positioning member mounted to the forward portion of said currency drawer enclosure.

7. The currency storage device of claim 6 wherein said currency positioning means further includes a bias means to bias said plunger and said currency positioning member in said first position.

8. The currency storage device of claim 6 wherein said currency receiving zone is cooperatively formed by said currency positioning member and a pair of lateral receiving zone flanges extending inwardly from opposite side walls of said currency drawer enclosure.

9. The currency storage device of claim 1 wherein said currency alignment means comprises an upper currency alignment structure to align currency in said currency receiving zone relative to said currency positioning means.

10. The currency storage device of claim 9 wherein said upper currency alignment structure comprises a first and second upper inclined currency alignment plate extending inwardly from the top wall of said currency drawer on opposite sides of said currency receiving aperture.

11. The currency storage device of claim 10 wherein said upper currency alignment structure further includes a pair of upper lateral inclined currency alignment camming surfaces formed on the side walls of said currency drawer adjacent to said currency receiving aperture.

12. The currency storage device of claim 11 wherein said upper currency alignment structure further includes inclined currency camming surface formed on the upper portion of said currency positioning means.

13. The currency storage device of claim 12 wherein said first and second upper inclined currency alignment plates extend toward each other, said first upper inclined currency alignment plate extends below said second upper inclined currency alignment plate toward said inclined camming surface to direct currency into said currency receiving zone.

14. The currency storage device of claim 9 wherein said currency alignment means further includes a lower alignment structure to align currency in said currency receiving zone relative to said currency storage tray aperture.

15. The currency storage device of claim 14 wherein said lower currency alignment structure comprises a lower currency alignment plate including an inclined camming surface formed on the lower portion of said currency positioning means.

16. The currency storage device of claim 2 wherein said inner currency storage tray comprises a currency tray having resilient bias currency storage retainer to retain currency therein.

17. The currency storage device of claim 1 wherein said currency drawer further includes a longitudinal currency storage tray alignment means to longitudinally align said inner currency storage tray longitudinally relative to the currency receiving zone.

18. The currency storage device of claim 17 further wherein said longitudinal currency storage tray alignment means comprises a first currency storage tray alignment member formed on said inner currency storage tray and a second currency storage tray alignment member formed on said outer currency drawer such that said inner currency storage tray is operatively disposed adjacent said currency receiving zone when said first currency storage tray alignment member engages said second currency storage tray alignment member.

19. The currency storage device of claim 2 further including a currency drawer securing means generally is affixed to said currency storage stand to selectively secure said currency drawer therein.

20. The currency storage device of claim 19 wherein said currency drawer securing means comprises a securing housing affixed to the interior of said currency storage stand and a key actuated securing member movable between a first and second position operably disposed within said securing housing to selectively secure said currency drawer within the currency drawer recess when in said second position.

21. The currency storage device of claim 20 wherein said currency drawer includes a securing aperture formed therein disposed to receive said key activated securing member when in said second position.

22. The currency storage device of claim 1 wherein said currency storage stand or pedestal comprises a currency storage housing having said currency drawer recess formed therein and a sleeve having a mounting flange formed about the outer periphery thereof secured within said currency drawer recess.

23. The currency storage device of claim 22 wherein metal sleeve is affixed to said currency storage housing by a plurality of outer fastening means attached to said mounting flange and an inner fastening means attached to the inner end of said sleeve.

* * * * *